US011621474B2

(12) United States Patent
Qin et al.

(10) Patent No.: US 11,621,474 B2
(45) Date of Patent: Apr. 4, 2023

(54) ANTENNA APPARATUS AND PREPARATION METHOD THEREOF

(71) Applicant: BOE TECHNOLOGY GROUP CO., LTD., Beijing (CN)

(72) Inventors: Guangkui Qin, Beijing (CN); Xiaoguang Xu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 837 days.

(21) Appl. No.: 16/466,358

(22) PCT Filed: Jan. 18, 2019

(86) PCT No.: PCT/CN2019/072386
§ 371 (c)(1),
(2) Date: Jun. 4, 2019

(87) PCT Pub. No.: WO2019/192245
PCT Pub. Date: Oct. 10, 2019

(65) Prior Publication Data

US 2021/0359397 A1 Nov. 18, 2021

(30) Foreign Application Priority Data

Apr. 4, 2018 (CN) ..... 201810305148.4

(51) Int. Cl.
*H01Q 1/24* (2006.01)
*H01Q 1/22* (2006.01)
(Continued)

(52) U.S. Cl.
CPC ..... *H01Q 1/248* (2013.01); *H01Q 1/225* (2013.01); *H01Q 1/38* (2013.01); *H01Q 21/30* (2013.01)

(58) Field of Classification Search
None
See application file for complete search history.

(56) References Cited

U.S. PATENT DOCUMENTS 8,299,655 B2 * 10/2012 Cutler ..... B82Y 30/00 307/151
8,823,023 B2 * 9/2014 Jinbo ..... H01L 33/62 438/66
(Continued)

FOREIGN PATENT DOCUMENTS

CN 1237807 A 12/1999
CN 1455474 A 11/2003
(Continued)

OTHER PUBLICATIONS

International Search Report dated Apr. 3, 2019, issued in counterpart application No. PCT/CN2019/072386 (11 pages).
(Continued)

*Primary Examiner* — Ab Salam Alkassim, Jr.
(74) *Attorney, Agent, or Firm* — WHDA, LLP

(57) ABSTRACT

The present disclosure relates to an antenna apparatus. The antenna apparatus may include a first substrate; a second substrate opposite the first substrate; a first antenna layer; an insulating layer; and a conductive layer. The first antenna layer may comprise a plurality of antenna units, each of the plurality of antenna units may comprise a radiation patch and is configured to receive the signals in one of the different frequency ranges. The insulating layer may comprise a plurality of sub-insulating layers; the conductive layer may comprise a plurality of conductive electrodes; and the plurality of the sub-insulating layers, the plurality of the conductive electrodes, and the plurality of the antenna units may be in one-to-one correspondence. The radiation patch, at least one of the plurality of conductive electrodes, and at least one of the plurality of sub-insulating layers may constitute a rectifier diode structure.

17 Claims, 9 Drawing Sheets

(51) Int. Cl.
*H01Q 1/38* (2006.01)
*H01Q 21/30* (2006.01)

(56) References Cited

U.S. PATENT DOCUMENTS

| | | | | |
|---|---|---|---|---|
| 11,233,320 | B2 * | 1/2022 | Lu | H01Q 3/44 |
| 2005/0130389 | A1 * | 6/2005 | Yamazaki | H01L 29/78603 438/455 |
| 2010/0328160 | A1 | 12/2010 | Hsu et al. | |
| 2011/0030757 | A1 * | 2/2011 | Lin | H01L 31/022433 136/244 |
| 2014/0085148 | A1 * | 3/2014 | Cutler | H01Q 1/26 343/701 |
| 2015/0243829 | A1 * | 8/2015 | Slater | H01L 21/31144 438/73 |
| 2016/0149441 | A1 * | 5/2016 | Nayak | H01Q 1/36 343/895 |
| 2016/0260755 | A1 * | 9/2016 | Davids | H01L 31/09 |
| 2017/0309766 | A1 * | 10/2017 | Cooke | H01L 31/0543 |
| 2017/0309767 | A1 * | 10/2017 | Cooke | H01L 31/048 |
| 2018/0294557 | A1 * | 10/2018 | Lu | H01Q 19/067 |
| 2018/0294562 | A1 * | 10/2018 | Lu | H01Q 1/52 |
| 2019/0288566 | A1 * | 9/2019 | Park | H02J 50/20 |
| 2020/0112106 | A1 * | 4/2020 | Misaki | H01Q 3/34 |
| 2020/0388934 | A1 * | 12/2020 | Misaki | H01Q 3/44 |
| 2021/0050651 | A1 * | 2/2021 | Jung | H01Q 1/38 |
| 2021/0210843 | A1 * | 7/2021 | Lu | H01Q 3/44 |
| 2021/0359656 | A1 * | 11/2021 | Ting | H03F 1/26 |
| 2021/0364832 | A1 * | 11/2021 | Kong | H01Q 1/241 |
| 2022/0102873 | A1 * | 3/2022 | Wang | H01Q 9/0457 |
| 2022/0115780 | A1 * | 4/2022 | Wang | H01Q 3/36 |
| 2022/0140491 | A1 * | 5/2022 | Wang | H01Q 9/0442 343/907 |
| 2022/0140800 | A1 * | 5/2022 | Fang | H01Q 3/36 343/850 |

FOREIGN PATENT DOCUMENTS

| | | | |
|---|---|---|---|
| CN | 101030526 | A | 9/2007 |
| CN | 103779655 | A | 5/2014 |
| CN | 104078770 | A | 10/2014 |
| CN | 105355705 | A | 2/2016 |
| CN | 106961008 | A | 7/2017 |
| CN | 107681261 | A | 2/2018 |
| DE | 102013001046 | B3 | 7/2014 |

OTHER PUBLICATIONS

Extended (Supplementary) European Search Report dated Nov. 29, 2021, issued in counterpart EP application No. 19728568.7. (14 pages).

Office Action dated Mar. 4, 2020, issued in counterpart CN Application No. 201810305148.4, with English translation (19 pages).

* cited by examiner

ANTENNA APPARATUS AND PREPARATION METHOD THEREOF

CROSS-REFERENCE TO RELATED APPLICATIONS

This application claims benefit of the filing date of Chinese Patent Application No. 201810305148.4 filed on Apr. 4, 2018, the disclosure of which is hereby incorporated in its entirety by reference.

TECHNICAL FIELD

The present disclosure relates to antenna technology, and particularly to an antenna apparatus and a preparation method thereof.

BACKGROUND

At present, main principle of an electromagnetic wave signal sensing method is to utilize an electromagnetic wave signal to form a DC signal for detection. Specifically, the method of forming the DC signal is different for signals of different wavelengths. For example, for microwaves and electromagnetic waves with long wavelengths, an antenna is usually used to receive electromagnetic waves, and a rectifier diode is then used to form DC current. For infrared light or visible light with a short wavelength, a semiconductor material or a quantum dot material is usually used to absorb photons and then form migration of electrons or holes to produce a direct current.

BRIEF SUMMARY

An embodiment of the present disclosure provides an antenna apparatus. The antenna apparatus may include a first substrate; a second substrate opposite the first substrate; a first antenna layer on a side of the second substrate facing the first substrate; an insulating layer on a side of the first antenna layer facing the first substrate; a conductive layer on a side of the insulating layer facing the first substrate. The first antenna layer may be configured to receive signals in different frequency ranges, and the first antenna layer, the insulating layer and the conductive layer are all between the first substrate and the second substrate. The first antenna layer may comprise a plurality of antenna units, each of the plurality of antenna units may comprise a radiation patch and is configured to receive the signals in one of the different frequency ranges. The insulating layer may comprise a plurality of sub-insulating layers; the conductive layer may comprise a plurality of conductive electrodes; and the plurality of the sub-insulating layers, the plurality of the conductive electrodes, and the plurality of the antenna units may be in one-to-one correspondence. The radiation patch, at least one of the plurality of conductive electrodes, and at least one of the plurality of sub-insulating layers may constitute a rectifier diode structure.

Optionally, at least one of the plurality of the antenna units further comprises a dielectric layer, and a ground electrode; the radiation patch is on a side of the dielectric layer facing the first substrate; and the ground electrode is on a side of the dielectric layer facing the second substrate.

Optionally, the antenna apparatus may further include a conductive wire for leading out the signals. The conductive wire is on the side of the dielectric layer facing the second substrate; an orthogonal projection of the conductive wire on the first substrate and an orthographic projection of the radiation patch on the first substrate overlap.

Optionally, a conductivity of the radiation patch is higher than a conductivity of the conductive electrode.

Optionally, an orthographic projection of the conductive electrode on the first substrate and an orthographic projection of the radiation patch on the first substrate have a first overlapping region.

Optionally, an orthographic projection of the sub-insulating layer on the first substrate overlaps the first overlapping region.

Optionally, the radiation patch comprises a plurality of micro-metal patches.

Optionally, each of the plurality of antenna units has a shape of a square or a rectangle and the plurality of micro-metal patches is distributed on the first substrate in a cluster or strip form.

Optionally, the conductive electrode and the radiation patch of a same antenna unit have a substantially same pattern.

Optionally, an orthographic projection of the conductive electrode on the first substrate covers an orthographic projection of the radiation patch of a same antenna unit on the first substrate.

Optionally, the conductive electrode is made of a transparent conductive material.

Optionally, the ground electrode has a shape of a square or a circle.

Optionally, the dielectric layer includes liquid crystals.

Optionally, the antenna apparatus further comprises a second antenna layer, wherein the second antenna layer is between the first substrate and the second substrate, and the second antenna layer is configured to radiate the signals.

Another example of the present disclosure is a method of preparing an antenna apparatus. The method may include providing a first substrate; forming a conductive layer on the first substrate, the conductive layer comprising a plurality of conductive electrodes; forming an insulating layer on a side of the conductive layer opposite from the first substrate, the insulating layer comprising a plurality of sub-insulating layers; providing a second substrate opposite the first substrate; and forming a first antenna layer between the insulating layer and the second substrate, the first antenna layer comprising a plurality of antenna units, each of the antenna units being configured to receive signals in a different frequency range. The first antenna layer comprises a radiation patch; the first antenna layer is configured to receive signals in different frequency ranges, and the first antenna layer, the insulating layer and the conductive layer are all between the first substrate and the second substrate. The first antenna layer comprises a plurality of antenna units, each of the plurality of antenna units being configured to receive the signals in one of the different frequency ranges; the insulating layer comprises a plurality of sub-insulating layers; the conductive layer comprises a plurality of conductive electrodes; and the plurality of the sub-insulating layers, the plurality of the conductive electrodes, and the plurality of the antenna units are in one-to-one correspondence. The radiation patch, at least one of the plurality of conductive electrodes, and at least one of the plurality of sub-insulating layers constitute a rectifier diode structure.

Optionally, forming the insulating layer on the side of the conductive layer opposite from the first substrate comprises forming the insulating layer on the side of the conductive layer opposite from the first substrate by a process of multiple exposures or a gray scale exposure.

Optionally, forming the first antenna layer between the insulating layer and the second substrate comprises forming a radiation patch on a side of the insulating layer opposite from the first substrate by a process of multiple exposures or a gray scale exposure; forming a ground electrode on a side of the second substrate facing the first substrate; and forming a dielectric layer between the ground electrode and the radiation patch.

Optionally, after the ground electrode is formed on the side of the second substrate facing the first substrate, the method further includes: forming a conductive wire on the side of the second substrate facing the first substrate, the conductive wire being configured to leading out the signals.

Optionally, The method for preparing the antenna apparatus may further comprise forming a second antenna layer on the first substrate or the second substrate, wherein the second antenna layer is configured to radiate the signals.

BRIEF DESCRIPTION OF THE DRAWINGS

The subject matter which is regarded as the disclosure is particularly pointed out and distinctly claimed in the claims at the conclusion of the specification. The foregoing and other objects, features, and advantages of the present disclosure are apparent from the following detailed description taken in conjunction with the accompanying drawings in which:

DETAILED DESCRIPTION

Figure 1:
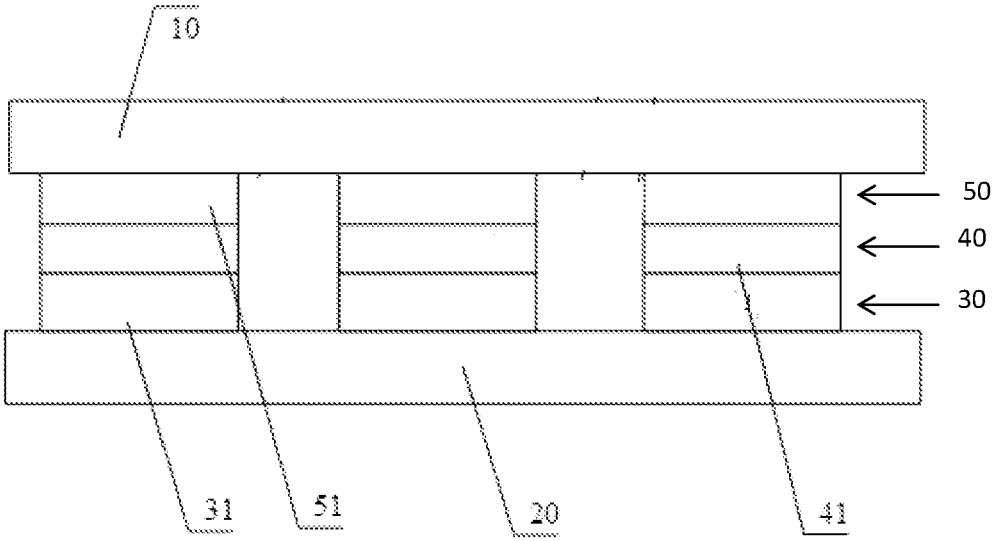
FIG. 1 is a schematic structural diagram of a signal processing apparatus according to one embodiment of the present disclosure.

The present disclosure will be described in further detail with reference to the accompanying drawings and embodiments in order to provide a better understanding by those skilled in the art of the technical solutions of the present disclosure. Throughout the description of the disclosure, reference is made to FIGS. 1-7. When referring to the figures, like structures and units shown throughout are indicated with like reference numerals.

In the description of the specification, references made to the term "some embodiment," "some embodiments," and "exemplary embodiments," "example," and "specific example," or "some examples" and the like are intended to refer that specific features and structures, materials or characteristics described in connection with the embodiment or example that are included in at least some embodiments or example of the present disclosure. The schematic expression of the terms does not necessarily refer to the same embodiment or example. Moreover, the specific features, structures, materials or characteristics described may be included in any suitable manner in any one or more embodiments or examples.

The steps illustrated in the flowchart of the figures may be executed in a computer system such as a set of computer executable instructions. Also, although the logical order is shown in the flowcharts, in some cases, the steps shown or described may be performed in a different order than the ones described herein.

Unless otherwise defined, technical terms or scientific terms used in the disclosure of the embodiments of the present disclosure should be construed in the ordinary meaning of those of ordinary skill in the art. The terms "first," "second," and similar terms used in the embodiments of the present disclosure do not denote any order, quantity, or importance, but are merely used to distinguish different components. The words "connected" or "coupled" and the like are not limited to physical or mechanical connections, but may include electrical connections, whether direct or indirect. "Up," "down," "left," "right," etc. are only used to indicate relative positional relationships, and when the absolute position of the described object is changed, the relative positional relationship may also change accordingly.

For high-frequency signals, because of the high frequency, it is difficult for ordinary metals to transmit such a high-frequency AC signal. Therefore, the antenna may be directly used as a rectifier diode electrode to directly convert the signal into a DC signal. Even so, the general diode cannot meet the high frequency requirements. Thus, a metal-insulator-metal (MIM) structure may be used to convert the high frequency AC signal to the DC signal.

FIG. 1 is a schematic structural diagram of a signal processing apparatus according to one embodiment of the present disclosure. As shown in FIG. 1, the signal processing apparatus includes a first substrate 10 and a second substrate 20 opposite the first substrate 10. The signal processing apparatus may further include a first antenna layer 30, an insulating layer 40, and a conductive layer 50 disposed between the first substrate 10 and the second substrate 20.

In one embodiment, the first antenna layer 30 is disposed on a side of the second substrate 20 facing the first substrate 10. The insulating layer 40 is disposed on a side of the first antenna layer 30 facing the first substrate 10. The conductive layer 50 is disposed on a side of the insulating layer 40 facing the first substrate 10.

In one embodiment, the first antenna layer 30 includes a plurality of antenna units 31, each for receiving signals in a different frequency range. The insulating layer 40 includes a plurality of sub-insulating layers 41. The conductive layer 50 includes a plurality of conductive electrodes 51. The plurality of sub-insulating layers 41 and the plurality of conductive electrodes 51 are in one-to-one correspondence with the plurality of antenna units 31.

In the embodiments, each antenna unit is configured to receive signals in a different frequency range such as in a range of 300 Mhz to 600 Mhz, or a range of 1 Ghz to 2.4 Ghz, or a range of 2.4 Ghz to 4.9 Ghz respectively. convert the received signals into an AC signals, transmit a part of the AC signals to the corresponding sub-insulation layer and the conductive electrode, and output another part of the AC signals. A capacitance is formed between each antenna unit, the corresponding sub-insulating layer and the conductive electrode, and the capacitance is functionally equivalent to a rectifying diode and converts the AC signals transmitted from the antenna unit into a corresponding direct current signal. The conductive electrode is used to output the direct current signal.

It should be noted that the plurality of sub-insulating layers and the plurality of conductive electrodes being in one-to-one correspondence with the plurality of antenna units indicates that the number of the sub-insulating layers, the number of the conductive electrodes, and the number of the antenna units are the same. The sub-insulating layers may be distributed in an array, the conductive electrodes may be distributed in an array, and the antenna units may be distributed in an array. However, the embodiments of the present disclosure are not limited to such distributions.

In some embodiments, each antenna unit is independent, and the signal in the received frequency range refers to an electromagnetic wave signal. In addition, the structure of each antenna unit may be same or different.

In addition, the signal processing apparatus provided by the embodiments of the present disclosure may further include an antenna structure of the existing electromagnetic wave monitoring system, wherein a processor is combined with a thin film transistor to rectify the AC signal of the antenna into a DC signal.

In one embodiment, the signal processing apparatus further includes: a processor (not in the figure). The processor is respectively connected to the conductive layer and the first antenna layer, and specifically, the processor is respectively connected to each of the conductive electrodes of the conductive layer and each of the antenna units of the first antenna layer.

In one embodiment, the processor is configured to detect a DC signal outputted by the conductive electrode, determine whether the signals received by the antenna unit include a signal of a preset frequency based on the DC signal, receive an AC signal when the signal of the preset frequency exists in the received signals, amplify the AC signal, and transmit the processed AC signal.

In some embodiments, the processor amplifies non-linearly the AC signal. On one hand, such amplification can improve the power. On the other hand, such amplification can remove effective information and radiate the processed AC signals out to form a co-channel interference signal, thereby overcoming the problem of being monitored and leaking information.

Optionally, the processor may be a central processing unit (CPU) or a micro controller unit (MCU).

In some embodiments, the antenna unit includes a microstrip antenna.

In some embodiments, the material for the sub-insulating layer includes silicon oxide, silicon nitride, or a composite of silicon oxide and silicon nitride.

In some embodiments, the number of antenna units for receiving signals in a certain frequency range is at least one. Considering the spatial energy density distribution, the antenna units for detecting signals in the same frequency range have the same size, and the antenna units for detecting signals in different frequency ranges have different sizes. In addition, the antenna units are arranged in an array between the first substrate and the second substrate. The larger the area occupied by the antenna units in the array, the larger the area for receiving the signals. The specific arrangement of the antenna units is not limited herein and can be determined according to the actual requirements.

It should be noted that the DC signals converted from signals in different frequency ranges are different. Therefore, the processor can detect the intensity and change of the electromagnetic wave signal received by the corresponding antenna unit based on the DC signal output by each conductive electrode, thereby realizing detection and analysis of signals of different bands.

In some embodiments, the first substrate 10 and the second substrate 20 may be a glass substrate, a plastic substrate, a quartz substrate, or the like.

The signal processing apparatus provided by some embodiments of the present disclosure includes: a first substrate and a second substrate opposite the first substrate. The signal process apparatus may further include a first antenna layer, an insulating layer and a conductive layer disposed between the first substrate and the second substrate. The first antenna layer is disposed on a side of the second substrate facing the first substrate; the insulating layer is disposed on a side of the first antenna layer facing the first substrate; and the conductive layer is disposed on a side of the insulating layer facing the first substrate. The first antenna layer includes a plurality of antenna units arranged in an array. Each of the antenna units is configured to receive signals in a different frequency range. The insulating layer includes a plurality of sub-insulating layers; the conductive layer includes a plurality of conductive electrodes; the plurality of sub-insulating layers, the plurality of conductive electrodes and the antenna units are in one-to-one correspondence.

In the embodiments of the present disclosure, by providing a plurality of sub-insulating layers, a plurality of conductive electrodes, and a plurality of antenna units, signals in a plurality of different frequency ranges can be received, thereby realizing detection of signals in a plurality of different frequency ranges. At the same time, the combination of the antenna unit, the sub-insulating layer and the conductive electrode capable of realizing the function of the rectifying diode is disposed between the first substrate and the second substrate, thereby avoiding separately disposed rectifying diodes as in the prior art.

In some embodiments, the signal processing apparatus further includes: a second antenna layer (not shown in the Figs). The second antenna layer is disposed between the first substrate and the second substrate for radiating out the processed AC signals as electromagnetic waves. In one embodiment, the processor is coupled to the second antenna layer for transmitting the processed AC signal to the second antenna layer.

In one embodiment, the second antenna layer includes: at least one antenna, and optionally, the antenna may be a microstrip antenna or the like.

Figure 2:
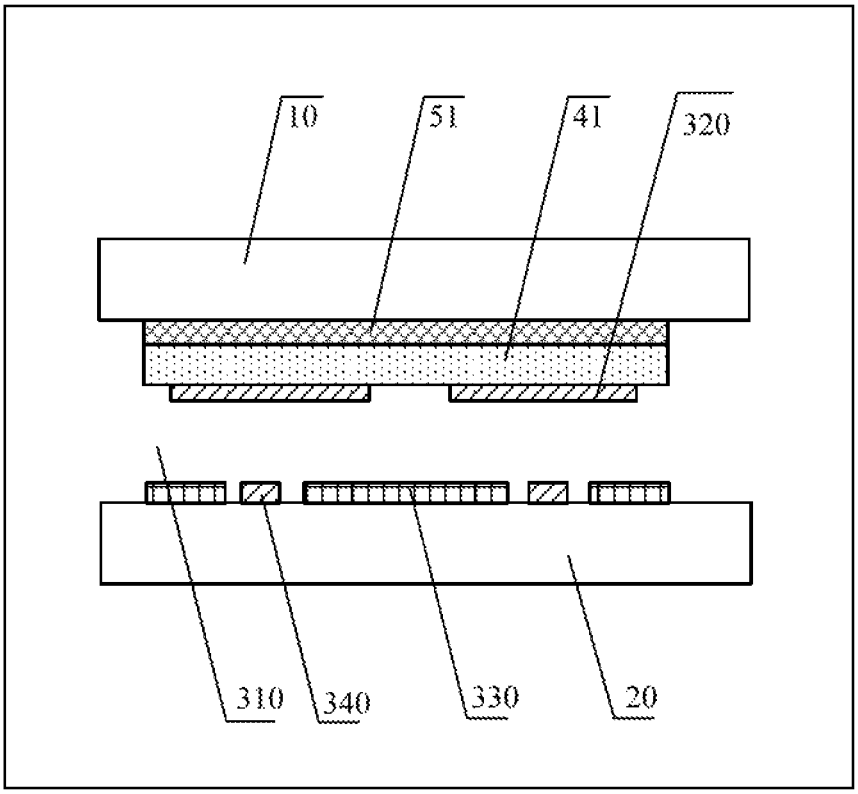
FIG. 2 is a schematic structural diagram of a signal processing apparatus according to one embodiment of the present disclosure.

FIG. 2 is a schematic structural diagram of a signal processing apparatus according to one embodiment of the present disclosure. As shown in FIG. 2, at least one antenna unit in the signal processing apparatus includes: a dielectric layer 310, a radiation patch 320, and a ground electrode 330.

It should be noted that the antenna unit in the embodiments of the present disclosure may be the structure described in FIG. 2, or may be an antenna structure in the existing electromagnetic wave monitoring system, which is not limited by this embodiments of the present disclosure.

In one embodiment, the radiation patch 320 is disposed on a side of the dielectric layer 310 facing the first substrate 10;

and the ground electrode 330 is disposed on a side of the dielectric layer 310 facing the second substrate 20.

In one embodiment, the shape of the grounding electrode is circular or square, and the material of the grounding electrode is made of metal, which is not limited in this embodiment of the present disclosure.

Figure 3:
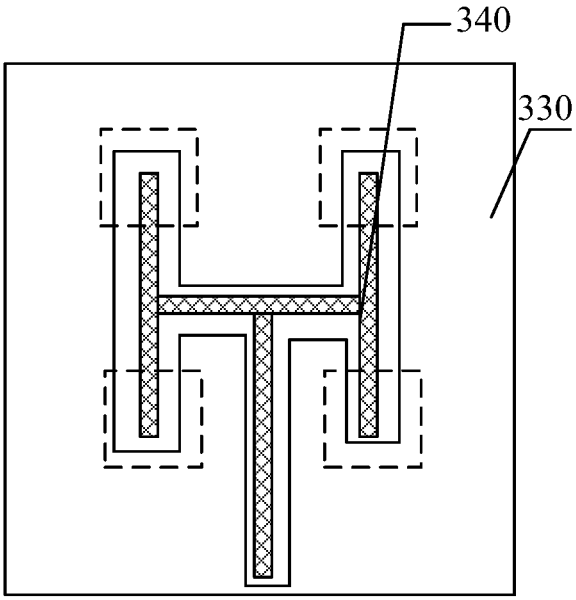
FIG. 3 is a top view of a signal processing apparatus according to one embodiment of the present disclosure.

FIG. 3 is a top plan view of a signal processing apparatus according to one embodiment of the present disclosure. FIG. 3 takes the example of a square ground electrode for illustration purpose only.

In one embodiment, the dielectric layer may be made of an insulating material such as silicon oxide, silicon nitride or a composite of silicon oxide and silicon nitride. The dielectric layer can also be made of a material with adjustable energy-saving coefficient such as liquid crystals. In this case, the specific frequency received by the antenna can be scanned within a certain range by adjusting the dielectric constant of the liquid crystals.

In some embodiments, as shown in FIG. 2, the signal processing apparatus may further include a conductive wire 340. The conductive wire 340 is used to lead out the AC signal sensed by the antenna unit.

In one embodiment, the conductive wire 340 may be disposed in the same layer as the ground electrode 330, or may be disposed on the side of the ground electrode 330 facing the first substrate 10. FIG. 2 and FIG. 3 are examples in which the conductive wire 340 and the ground electrode 330 are in the same layer. However, the embodiments of the present disclosure are not limited thereto.

In one embodiment, the orthogonal projection of the conductive wire 340 on the first substrate and the orthographic projection of the radiation patch on the first substrate have overlapping regions.

In one embodiment, in order to sense the AC signal converted by the micro-metal patch, the conductive wire is made of the same material as the micro-metal patch.

In one embodiment, in order to transmit the sensed AC signal, the material of the conductive wire is different from the material of the ground electrode.

In one embodiment, the conductive wire and the ground electrode are used to sense the AC signal oscillated by the radiation patch, and transmit the AC signal to the processor through the conductive wire.

In one embodiment, as shown in FIG. 3, the conductive wire 340 is of the H-type. In order to ensure that the antenna unit can lead out the AC signals, the orthographic projection of the conductive wire on the first substrate and the orthographic projection of the radiation patch on the first substrate overlap.

In one embodiment, the conductive wire 340 is a transmission line.

In one embodiment, in order to ensure that the signal processing apparatus can rectify the AC signal converted by the antenna unit, the conductivity of the radiation patch 320 is greater than the conductivity of the conductive electrode.

In some embodiments, the materials of the radiation patches included in the plurality of antenna units may be the same or different, and may be determined according to actual needs. In one embodiment, in order to simplify the process, the radiation patches of the plurality of antenna units may be made of the same material.

In some embodiments, the radiation patch and the conductive electrode are made of different materials. The radiation patch is made of a metal having a small resistivity such as gold, and the conductive electrode is made of a transparent conductive material.

In some embodiments, the material of the conductive electrode includes indium tin oxide ITO, and the shape of the conductive electrode may be a square shape, and may also be a circular shape, which is determined according to actual needs, and is not limited in this embodiment of the present disclosure.

In one embodiment, the radiation patch in the antenna unit forms a capacitance with the corresponding sub-insulating layer and the conductive electrode. Because the conductivity of the radiation patch and the conductivity of the conductive electrode are different, the work functions of the radiation patch and the conductive electrode are also different. The AC signal converted by the radiation patch transmits only a positive level under the action of the radiation patch, the sub-insulation layer and the conductive electrode, and cannot transmit a negative level. That is, the radiation patch, the sub-insulating layer, and the conductive electrode are functionally equivalent to the rectifier diode.

In some embodiments, in order to ensure that the radiation patch, the sub-insulating layer and the conductive electrode are functionally equivalent to the rectifier diode, the orthographic projection of the conductive electrode on the first substrate and the orthographic projection of the radiation patch on the first substrate have a first overlapping region. Furthermore, an orthographic projection of the sub-insulating layer on the first substrate overlap the first overlapping region to produce a second overlapping region. That is, the conductive electrode, the sub-insulating layer, and the radiation patch form a capacitor.

Figure 4:
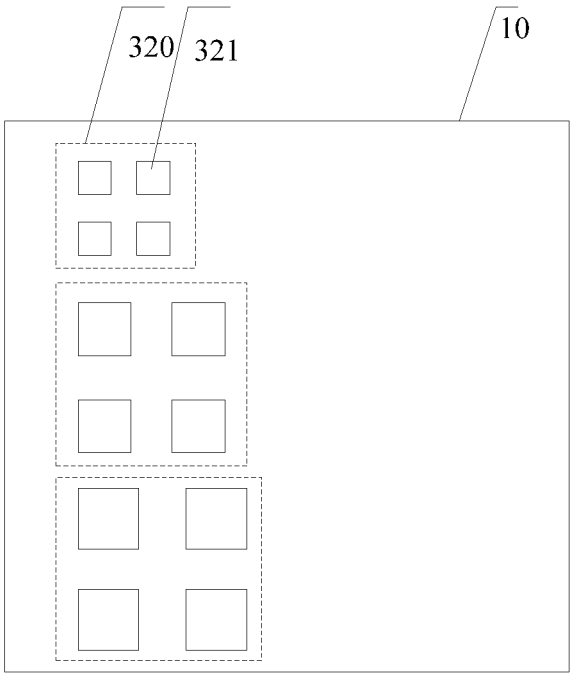
FIG. 4 is a top view of a signal processing apparatus according to one embodiment of the present disclosure.

FIG. 4 is a top view of a signal processing apparatus according to one embodiment of the present disclosure. As shown in FIG. 4, the radiation patch 320 of each antenna unit includes: a plurality of micro-metal patches 321.

In one embodiment, the number of the micro-metal patches 321 in an antenna unit may be an even number. The specific number of the micro-metal patches 321 in an antenna unit may be determined according to actual needs. The number of micro-metal patches included in each antenna unit may be the same or different. FIG. 4 shows an example in which each antenna unit includes four micro-metal patches.

It should be noted that in order to avoid the bulk of the microstrip antenna, the number of micro-metal patches in each antenna does not need to be too large.

In some embodiments, the shape of the micro-metal patch may be a rectangle or a square shape. FIG. 4 is an example in which the micro-metal patch is a square shape, and the embodiment of the present disclosure is not limited thereto.

In some embodiments, the sizes of the micro-metal patches of the antenna units for receiving signals in different frequency ranges are different, and specifically, the size includes the length, width or thickness of the micro-metal patch.

Figure 5A:
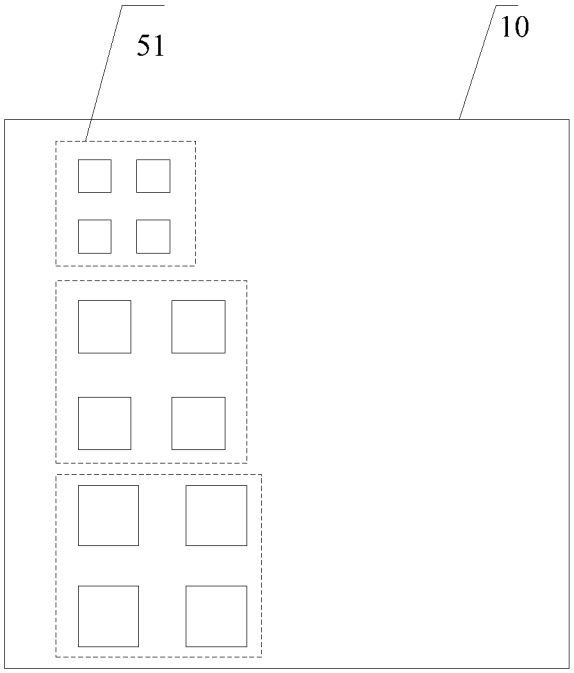
FIG. 5A is a top view of a conductive electrode according to one embodiment of the present disclosure.

FIG. 5A is a top view of a conductive electrode according to one embodiment of the present disclosure. As shown in FIG. 5A, in order to prevent the conductive electrode from blocking the AC signal, the pattern of the conductive electrode 51 may be the same as the pattern of the radiation patch of the corresponding antenna unit. That is, the orthographic projection of the conductive electrode on the first substrate coincides with the orthographic projection of the radiation patch of the corresponding antenna unit on the first substrate.

Figure 5B:
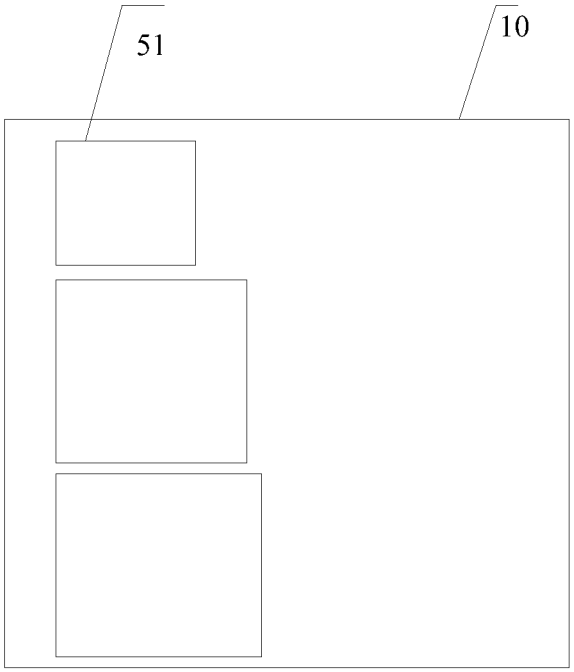
FIG. 5B is a top view of a conductive electrode according to one embodiment of the present disclosure.

FIG. 5B is a top view of a conductive electrode according to one embodiment of the present disclosure. As shown in FIG. 5B, the orthographic projection of the conductive electrode 51 on the first substrate covers the orthographic projection of the radiation patch of the corresponding antenna unit on the first substrate. In this embodiment, the conductive layer is made of a material having a high resistivity, and the conductive layer has almost no blocking effect on the AC signal due to the higher resistivity.

Figure 6A:
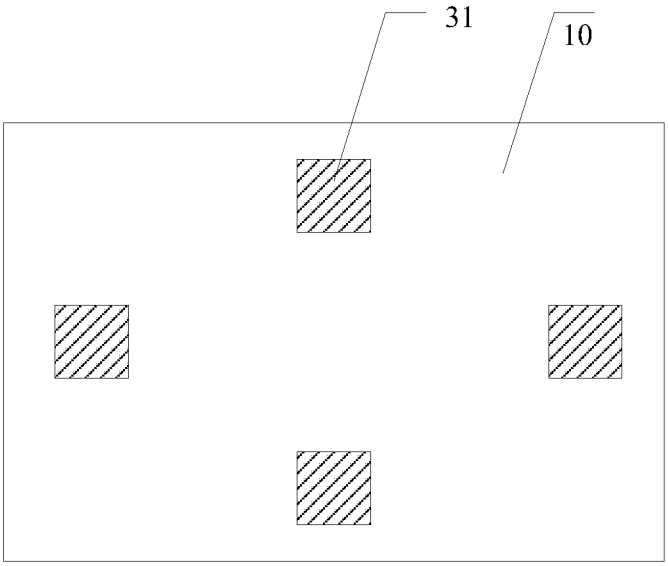
FIG. 6A is a schematic diagram of distribution of antenna units according to one embodiment of the present disclosure.
Figure 6B:
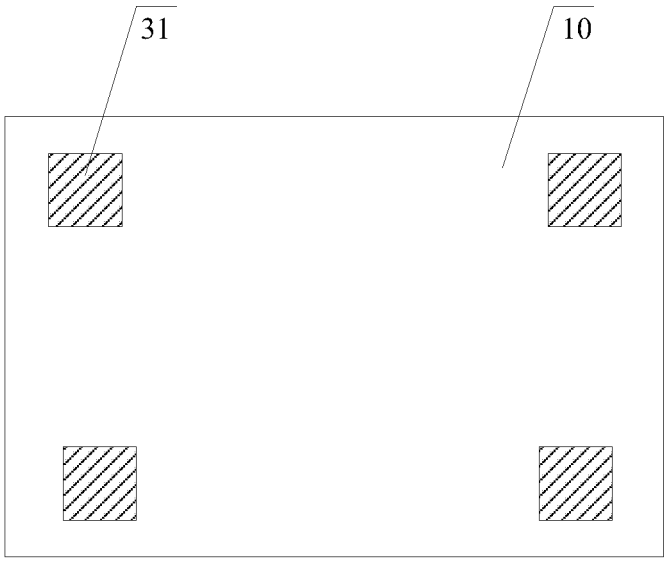
FIG. 6B is a schematic diagram of distribution of antenna units according to one embodiment of the present disclosure.
Figure 6C:
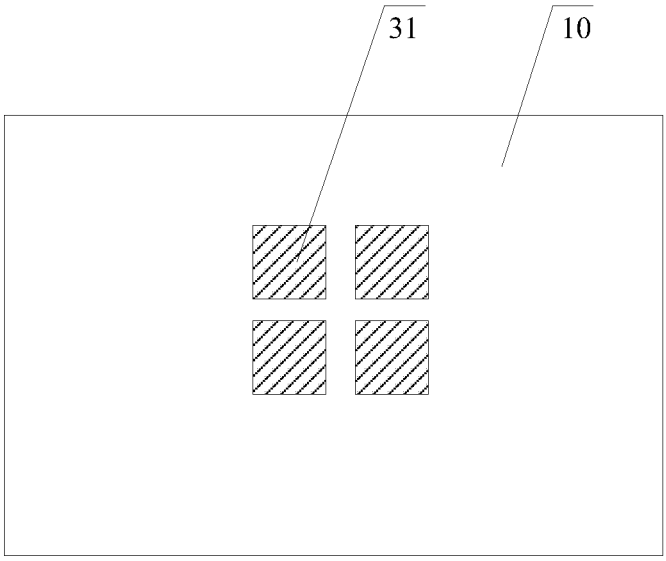
FIG. 6C is a schematic diagram of distribution of antenna units according to one embodiment of the present disclosure.
Figure 6D:
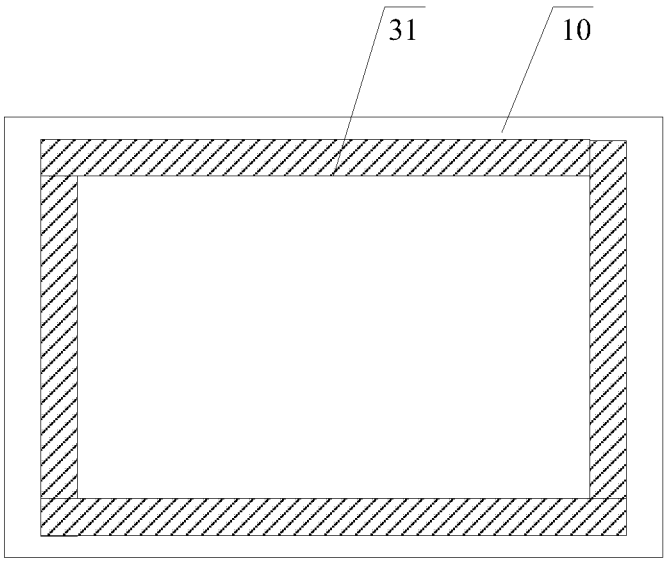
FIG. 6D is a schematic diagram of distribution of antenna units according to one embodiment of the present disclosure.
Figure 6E:
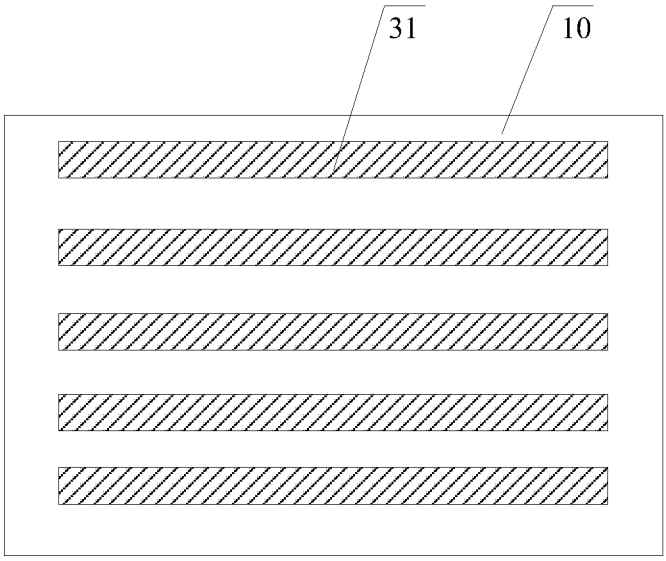
FIG. 6E is a schematic diagram of distribution of antenna units according to one embodiment of the present disclosure.
Figure 6F:
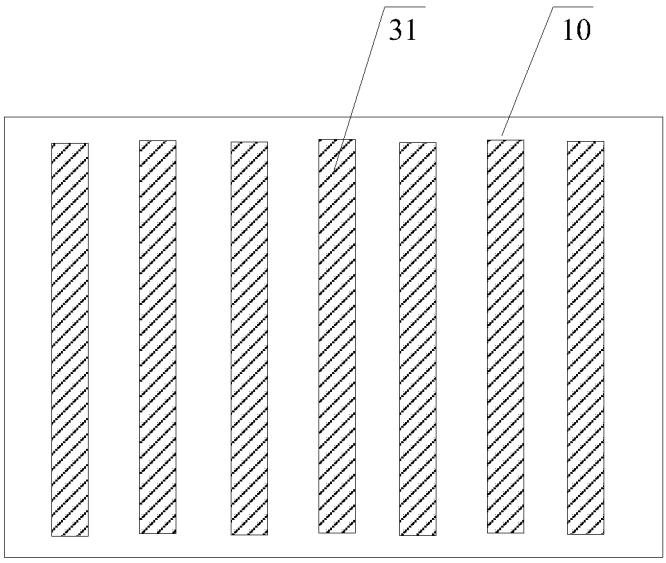
FIG. 6F is a schematic diagram of distribution of antenna units according to one embodiment of the present disclosure.

In some embodiments, the micro-metal patches 321 are distributed on the first substrate 10 in a cluster or strip form. FIGS. 6A-6F are schematic diagrams showing the distribution of micro-metal patches according to embodiments of the present disclosure. FIG. 6A illustrates an example in which antenna units 31 are distributed in a cluster form around the first substrate. FIG. 6B shows an example in which antenna units 31 are distributed in clusters on four corners of the first substrate. FIG. 6C shows an example in which antenna units 31 are distributed in the form of a cluster at the center of the first substrate. FIG. 6D illustrates an example in which antenna units 31 are distributed in a strip form around the first substrate. FIG. 6E illustrates an example in which the antenna units 31 are laterally distributed on the entire first substrate. FIG. 6F illustrates an example in which the antenna units 31 are longitudinally distributed on the entire first substrate. The distribution of the antenna units 31 is not specifically limited in the embodiment of the present disclosure.

In one embodiment, each of the plurality of antenna units 31 has a shape of a square or a rectangle and the plurality of antenna units 31 is distributed on the first substrate in a cluster or strip form.

It should be noted that the structure of the plurality of antenna units in the embodiments of the present disclosure may be similar, and the difference thereof is only the size of the antenna unit, such as the length, width or thickness of the micro-metal patch.

Without being held to a particular theory, the operating principle of the signal processing apparatus provided by the embodiment of the present disclosure is specifically described below:

A plurality of micro-metal patches in the antenna unit receive electromagnetic wave signals in a certain frequency range, and converts the received electromagnetic wave signals into AC signals. A part of the AC signals is converted into a DC signal under the rectification of the micro-metal patches, the corresponding sub-insulation layer and the conductive electrode. At the same time, another part of the AC signals converted by the antenna unit is transmitted to the processor under the action of the conductive layer, the dielectric layer, the ground electrode and the micro-metal patch. The processor detects the DC signal, and determines whether the received signals have a signal of a preset frequency based on the DC current. If yes, the processor performs nonlinear amplification processing on the corresponding AC signals of the received signals, and transmits the processed AC signals to the second antenna layer. The second antenna layer radiates out the received processed AC signal in the form of electromagnetic waves for signal interference.

Since the frequency bands for the first and second antennas are different, mutual interference does not occur substantially as long as the positions of the first and second antennas do not overlap.

Figure 7:
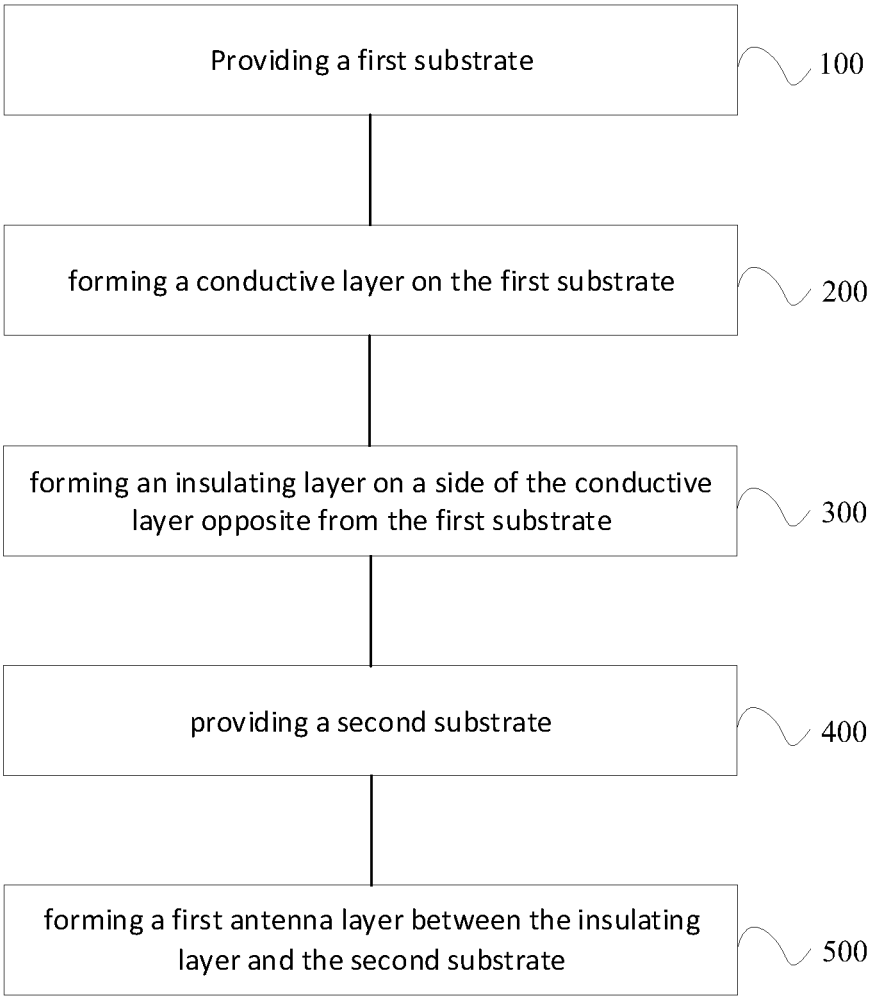
FIG. 7 is a flowchart of a method for preparing a signal processing apparatus according to one embodiment of the present disclosure.

Another example of the present disclosure also provides a method for preparing a signal processing apparatus according to one embodiment of the present disclosure. FIG. 7 is a flowchart of a method for fabricating a signal processing apparatus according to one embodiment of the present disclosure. As shown in FIG. 7, the signal processing apparatus provided by the embodiment of the present disclosure includes the following steps:

Step 100 includes providing a first substrate. The first substrate may be a glass substrate, a plastic substrate, a quartz substrate, or the like, and the embodiment of the present disclosure is not limited thereto.

Step 200 includes forming a conductive layer on the first substrate. The conductive layer may include a plurality of conductive electrodes. In some embodiments, the step 200 specifically includes: depositing a transparent conductive film on the first substrate, and forming a conductive layer including a plurality of conductive electrodes by a patterning process.

Step 300 includes forming an insulating layer on a side of the conductive layer opposite from the first substrate. In some embodiments, the insulating layer includes: a plurality of sub-insulating layers. It should be noted that the plurality of sub-insulating layers are disposed in the same layer.

In some embodiments, the material for fabricating the sub-insulating layer includes silicon oxide, silicon nitride or a composite of silicon oxide and silicon nitride.

In some embodiments, step 300 includes depositing an insulating material on a side of the conductive layer opposite from the first substrate and processing the insulating material by using a process of multiple exposure or gray scale exposure to form the insulating layer.

It should be noted that the thickness of the sub-insulating layer corresponding to different antenna units may be the same or different and the embodiment of the present disclosure does not limit thereto.

In some embodiments, the width of the wavelength band to be detected is wide in the embodiment of the present disclosure, and requirements for the material performance are different for the electromagnetic waves at different frequencies. The insulating layer provided by the embodiments of the present disclosure can adopt the following two processes. The first process includes a plurality of exposures. In particular, different masks can be used to perform the multiple exposure processes to form micro-metal patches of different frequencies. The second process includes gray-scale exposure. In addition to the use of different insulation materials, the object can be achieved with different technical thickness of the insulating layer. In order to achieve different insulation thickness in one process, the thickness of the insulation layer can be controlled by controlling the exposure intensity.

Step 400 includes providing a second substrate. In one embodiment, the second substrate may be a glass substrate, a plastic substrate, a quartz substrate, or the like, and the embodiment of the present disclosure is not limited thereto.

Step 500 involves forming a first antenna layer between the insulating layer and the second substrate. In some embodiments, the first antenna layer includes a plurality of antenna units, each of which is configured to receive signals in a different frequency range.

In some embodiments, step 500 specifically includes forming a radiation patch on a side of the insulating layer opposite from the first substrate by using a process of multiple exposures or gray scale exposure and forming a ground electrode on a side of the second substrate facing the first substrate. A dielectric layer is provided between the ground electrode and the radiation patch.

In some embodiments, the materials of the radiation patches included in the plurality of antenna units may be the same or different, and may be determined according to actual needs. In one embodiment, in order to simplify the process, the radiation patches of the plurality of antenna units may be made of the same material.

In one embodiment, the plurality of sub-insulating layers, the plurality of conductive electrodes and the plurality of antenna units are in one-to-one correspondence.

In one embodiment, in order to ensure the conductivity of the radiation patch, the radiation patch used is made of gold.

In some embodiments, the width of the wavelength band to be detected is wide in the embodiment of the present disclosure, and requirements for the material performance are different for the electromagnetic waves at different frequencies. The radiation patch provided by the specific embodiment of the present disclosure can adopt the following two processes. The first process includes a plurality of exposures. As the frequency range gradually increases, the resistance required for micro-metal patches is getting lower and lower. If different materials are used, different masks can be used for multiple exposure processes to form micro-metal patches of different frequencies. The second process involves grayscale exposure. Different requirement on resistance of micro-metal patches are needed for electromagnetic waves of different frequency ranges. Different resistance can be achieved by using different metal materials as well as different technical thicknesses of the micro-metal patches. In order to achieve different metal thicknesses in a single process, the thickness of the metal material is controlled by controlling the exposure intensity.

In the embodiments of the present disclosure, a plurality of conductive electrodes, a plurality of sub-insulating layers and a plurality of antenna units are simultaneously prepared, which simplifies the process flow and saves costs.

The method for fabricating a signal processing apparatus according to one embodiment of the present disclosure includes providing a first substrate and forming a conductive layer on the first substrate. The conductive layer includes a plurality of conductive electrodes. The method further includes forming an insulating layer on a side of the conductive layer opposite from the first substrate. The insulating layer includes a plurality of sub-insulating layers. The method further includes providing a second substrate and forming a first antenna layer between the insulating layer and the second substrate. The first antenna layer may include a plurality of antenna units. Each antenna unit is used for receiving signals in a different frequency range. The plurality of sub-insulating layers, the plurality of conductive electrodes and the plurality of antenna units are in one-to-one correspondence. In the embodiments of the present disclosure, by providing a plurality of sub-insulation layers, a plurality of conductive electrodes and a plurality of antenna units, signals in a plurality of different frequency ranges can be received, thereby realizing detection of signals in a plurality of different frequency ranges. At the same time, the antenna unit, the sub-insulating layer and the conductive electrode capable of realizing the function of the rectifying diode are disposed between the first substrate and the second substrate, thereby avoiding separately disposing the rectifying diode as in the prior art.

In some embodiments, after the grounding electrode is formed on the side of the second substrate facing the first substrate, the method further includes forming a conductive wire for leading out the signals on a side of the second substrate facing the first substrate.

In some embodiments, the method for fabricating a signal processing apparatus according to one embodiment of the present disclosure further includes forming a second antenna layer for radiating signals on the first substrate or the second substrate. Specifically, the step may be before the step 200, or after the step 200, the embodiment of the present disclosure is not limited thereto.

The drawings of the embodiments of the present disclosure refer to only the structures involved in the embodiments of the present disclosure, and other structures may refer to the general design. For the sake of clarity, the thickness and size of the layers or microstructures are exaggerated in the figures used to describe embodiments of the disclosure. When an unit such as a layer, a film, a region or a substrate is referred to as being "on" or "under" another unit, the unit can be "directly" on or under the another unit, or there are intermediate components between the two units.

The principle and the embodiment of the present disclosures are set forth in the specification. The description of the embodiments of the present disclosure is only used to help understand the method of the present disclosure and the core idea thereof. Meanwhile, for a person of ordinary skill in the art, the disclosure relates to the scope of the disclosure, and the technical scheme is not limited to the specific combination of the technical features, and also should covered other technical schemes which are formed by combining the technical features or the equivalent features of the technical features without departing from the inventive concept. For example, technical scheme may be obtained by replacing the features described above as disclosed in this disclosure (but not limited to) with similar features.

What is claimed is:

1. An antenna apparatus, comprising:

a first substrate;

a second substrate opposite the first substrate;

a first antenna layer on a side of the second substrate facing the first substrate an insulating layer on a side of the first antenna layer facing the first substrate;

a conductive layer on a side of the insulating layer facing the first substrate;

wherein the first antenna layer is configured to receive signals in different frequency ranges, and the first antenna layer, the insulating layer and the conductive layer are all between the first substrate and the second substrate;

wherein the first antenna layer comprises a plurality of antenna units, each of the plurality of antenna units comprises a radiation patch and is configured to receive the signals in one of the different frequency ranges; the insulating layer comprises a plurality of sub-insulating layers; the conductive layer comprises a plurality of conductive electrodes; and the plurality of the sub-insulating layers, the plurality of the conductive electrodes, and the plurality of the antenna units are in one-to-one correspondence;

wherein the radiation patch, the insulating layer, and the conductive layer are stacked together layer by layer;

wherein the radiation patch, at least one of the plurality of conductive electrodes, and at least one of the plurality of sub-insulating layers constitute a rectifier diode structure;

wherein at least one of the plurality of the antenna units further comprises a dielectric layer, and a ground electrode, the radiation patch is on a side of the dielectric layer facing the first substrate, and the ground electrode is on a side of the dielectric layer facing the second substrate; and wherein the antenna apparatus further comprises a conductive wire for leading out the signals;

wherein the conductive wire is on the side of the dielectric layer facing the second substrate, an orthogonal projection of the conductive wire on the first substrate and an orthographic projection of the radiation patch on the first substrate overlap; and wherein each of the plurality of antenna units is configured to convert a received signal into an AC signal, transmit a part of the AC signal to a corresponding sub-insulating layer and a corresponding conductive electrode, and output another part of the AC signal through the conductive wire.

2. The antenna apparatus of claim 1, wherein a conductivity of the radiation patch is higher than a conductivity of the conductive electrode.

3. The antenna apparatus of claim 1, wherein an orthographic projection of the conductive electrode on the first substrate and an orthographic projection of the radiation patch on the first substrate have a first overlapping region.

4. The antenna apparatus of claim 3, wherein an orthographic projection of the sub-insulating layer on the first substrate overlaps the first overlapping region.

5. The antenna apparatus of claim 1, wherein the radiation patch comprises a plurality of metal patches.

6. The antenna apparatus of claim 1, wherein each of the plurality of antenna units has a shape of a square or a rectangle and the plurality of antenna units is distributed on the first substrate in a cluster or strip form.

7. The antenna apparatus of claim 1, wherein the conductive electrode and the radiation patch of a same antenna unit have a substantially same pattern.

8. The antenna apparatus of claim 6, wherein an orthographic projection of the conductive electrode on the first substrate covers an orthographic projection of the radiation patch of a same antenna unit on the first substrate.

9. The antenna apparatus of claim 1, wherein the conductive electrode is made of a transparent conductive material.

10. The antenna apparatus of claim 1, wherein the ground electrode has a shape of a square or a circle.

11. The antenna apparatus of claim 1, wherein the dielectric layer includes liquid crystals.

12. The antenna apparatus of claim 1, further comprising a second antenna layer, wherein the second antenna layer is between the first substrate and the second substrate, and the second antenna layer is configured to radiate the signals, and orthographic projection of the first antenna layer on the first substrate and orthographic projection of the second antenna layer on the first substrate do not overlap.

13. The antenna apparatus of claim 1, wherein the conductive wire is disposed in a same layer as the ground electrode.

14. A method of preparing an antenna apparatus, comprising: providing a first substrate; forming a conductive layer on the first substrate, the conductive layer comprising a plurality of conductive electrodes; forming an insulating layer on a side of the conductive layer opposite from the first substrate, the insulating layer comprising a plurality of sub-insulating layers; providing a second substrate opposite the first substrate; and forming a first antenna layer between the insulating layer and the second substrate, the first antenna layer comprising a plurality of antenna units, each of the antenna units being configured to receive signals in a different frequency range; wherein the first antenna layer is configured to receive signals in different frequency ranges, and the first antenna layer, the insulating layer and the conductive layer are all between the first substrate and the second substrate; wherein the first antenna layer comprises a plurality of antenna units, each of the plurality of antenna units comprises a radiation patch and is configured to receive the signals in one of the different frequency ranges; the insulating layer comprises a plurality of sub-insulating layers; the conductive layer comprises a plurality of conductive electrodes; and the plurality of the sub-insulating layers, the plurality of the conductive electrodes, and the plurality of the antenna units are in one-to-one correspondence; wherein the radiation patch, the insulating layer, and the conductive layer are stacked together layer by layer; and wherein the radiation patch, at least one of the plurality of conductive electrodes, and at least one of the plurality of sub-insulating layers constitute a rectifier diode structure, wherein forming the first antenna layer between the insulating layer and the second substrate comprises: forming a radiation patch on a side of the insulating layer opposite from the first substrate by a process of multiple exposures or a gray scale exposure; forming a ground electrode on a side of the second substrate facing the first substrate; and forming a dielectric layer between the ground electrode and the radiation patch; and wherein after the ground electrode is formed on the side of the second substrate facing the first substrate, the method further includes: forming a conductive wire on the side of the second substrate facing the first substrate, the conductive wire for being configured to leading out the signals; and each of the plurality of antenna units is configured to convert a received signal into an AC signal, transmit a part of the AC signal to a corresponding sub-insulating layer and a corresponding conductive electrode, and output another part of the AC signal through the conductive wire.

15. The method of preparing the antenna apparatus of claim 14, wherein forming the insulating layer on the side of the conductive layer opposite from the first substrate comprises forming the insulating layer on the side of the conductive layer opposite from the first substrate by a process of multiple exposures or a gray scale exposure.

16. The method for preparing the antenna apparatus of claim 14, further comprising forming a second antenna layer on the first substrate or the second substrate, wherein the second antenna layer is configured to radiate the signals.

17. The method for preparing the antenna apparatus of claim 14, wherein the conductive wire is disposed in a same layer as the ground electrode.

* * * * *